US009893452B2

(12) United States Patent
Wagman et al.

(10) Patent No.: US 9,893,452 B2
(45) Date of Patent: Feb. 13, 2018

(54) LOW-PROFILE SPRING-LOADED CONTACTS

(71) Applicant: Apple Inc., Cupertino, CA (US)

(72) Inventors: Daniel C. Wagman, Los Gatos, CA (US); Eric S. Jol, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/138,224

(22) Filed: Apr. 26, 2016

(65) Prior Publication Data

US 2017/0069993 A1 Mar. 9, 2017

Related U.S. Application Data

(60) Provisional application No. 62/215,592, filed on Sep. 8, 2015.

(51) Int. Cl.

| | |
|---|---|
| ***H01R 13/44*** | (2006.01) |
| ***H01R 13/24*** | (2006.01) |
| ***H01R 13/41*** | (2006.01) |
| ***H01R 43/16*** | (2006.01) |
| ***H01R 43/20*** | (2006.01) |
| ***H01R 13/428*** | (2006.01) |

(52) U.S. Cl.

CPC ..... *H01R 13/2442* (2013.01); *H01R 13/2421* (2013.01); *H01R 13/41* (2013.01); *H01R 13/428* (2013.01); *H01R 43/16* (2013.01); *H01R 43/20* (2013.01); *H01R 13/2471* (2013.01); *H01R 13/2478* (2013.01)

(58) Field of Classification Search

CPC ..... H01R 13/4536; H01R 13/447; H01R 13/65802; H01R 11/288

USPC ..... 439/138, 136, 892, 95, 910

See application file for complete search history.

(56) References Cited

U.S. PATENT DOCUMENTS

| | | | | |
|---|---|---|---|---|
| 5,213,314 | A | 5/1993 | Kano et al. | |
| 5,295,844 | A * | 3/1994 | Koshikawa | H01R 13/6485 439/138 |
| 5,980,335 | A | 11/1999 | Barbieri et al. | |
| 7,306,494 | B2 * | 12/2007 | Soh | H01R 13/2442 439/862 |
| 7,661,968 | B1 * | 2/2010 | Duan | H01R 13/2442 439/135 |
| 8,066,518 | B2 | 11/2011 | Homme et al. | |
| 8,344,836 | B2 | 1/2013 | Lauder | |
| 8,427,825 | B2 | 4/2013 | Szczypinski | |

(Continued)

FOREIGN PATENT DOCUMENTS

| | | |
|---|---|---|
| CN | 101755368 A | 6/2010 |
| JP | H0577772 U | 10/1993 |

(Continued)

OTHER PUBLICATIONS

Ex parte Quayle Action dated Jun. 27, 2017 in U.S. Appl. No. 15/256,470, 8 pages.

(Continued)

*Primary Examiner* — Phuongchi T Nguyen

(74) *Attorney, Agent, or Firm* — Kilpatrick Townsend & Stockton, LLP

(57) ABSTRACT

Contact structures that are readily manufactured, where contacts in the contact structures provide a sufficient normal force while consuming a minimal amount of surface area, depth, and volume in an electronic device.

18 Claims, 17 Drawing Sheets

(56) References Cited

U.S. PATENT DOCUMENTS

| | | | |
|---|---|---|---|
| 8,498,100 | B1 | 7/2013 | Whitt, III |
| 8,570,725 | B2 | 10/2013 | Whitt, III |
| 8,699,215 | B2 | 4/2014 | Whitt, III |
| 8,724,302 | B2 | 5/2014 | Whitt, III |
| 8,780,540 | B2 | 7/2014 | Whitt, III |
| 8,780,541 | B2 | 7/2014 | Whitt, III |
| 8,830,668 | B2 | 9/2014 | Whitt, III |
| 8,873,227 | B2 | 10/2014 | Whitt, III |
| 8,878,637 | B2 | 11/2014 | Sartee |
| 8,903,517 | B2 | 12/2014 | Perek |
| 8,947,864 | B2 | 2/2015 | Whitt, III |
| 8,953,310 | B2 | 2/2015 | Smith |
| 8,975,991 | B2 | 3/2015 | Lauder |
| 8,988,876 | B2 | 3/2015 | Corbin |
| 9,000,871 | B2 | 4/2015 | Cencioni |
| 9,036,340 | B1 | 5/2015 | Colby |
| 9,075,566 | B2 | 7/2015 | Whitt, III |
| 9,149,100 | B2 | 10/2015 | Marshall |
| 9,158,384 | B2 | 10/2015 | Whitt, III |
| 9,176,900 | B2 | 11/2015 | Whitt, III |
| 9,176,901 | B2 | 11/2015 | Whitt, III |
| 9,331,415 | B2 | 5/2016 | Tagawa |
| 9,335,793 | B2 | 5/2016 | Rothkopf |
| 9,455,759 | B2 | 9/2016 | Jen |
| 9,485,338 | B2 | 11/2016 | Balaji |
| 2004/0209489 | A1 | 10/2004 | Clapper |
| 2005/0026499 | A1 | 2/2005 | Choi |
| 2009/0247004 | A1 | 10/2009 | Lou |
| 2009/0257207 | A1 | 10/2009 | Wang |
| 2010/0328230 | A1 | 12/2010 | Faubert |
| 2011/0051360 | A1 | 3/2011 | Dabov |
| 2012/0194448 | A1 | 8/2012 | Rothkopf |
| 2013/0035006 | A1 | 2/2013 | Park et al. |
| 2013/0162554 | A1 | 6/2013 | Lauder |
| 2013/0183861 | A1 | 7/2013 | Chang et al. |
| 2014/0106594 | A1 | 4/2014 | Skvoretz |
| 2014/0204514 | A1 | 7/2014 | Whitt, III |
| 2014/0273546 | A1 | 9/2014 | Harmon |
| 2014/0377992 | A1 | 12/2014 | Chang et al. |
| 2015/0194764 | A1 | 7/2015 | Magana |

FOREIGN PATENT DOCUMENTS

| | | | |
|---|---|---|---|
| JP | H0662474 | U | 9/1994 |
| JP | H083932 | Y2 | 1/1996 |
| JP | S6323776 | U | 2/1998 |
| JP | H11329634 | A | 11/1999 |
| JP | 2013182839 | A | 9/2013 |
| KR | 10-2006-0039930 | A | 5/2006 |
| KR | 10-2013-0015367 | A | 2/2013 |

OTHER PUBLICATIONS

European Search Report dated Jan. 20, 2017 in European Patent Application No. 16186530.8, 12 pages.

Examination Report No. 1 dated Apr. 27, 2017 in Australian Patent Application No. 20162225604, 4 pages.

Office Action and Search Report (English Translation) dated May 25, 2017 in Taiwan Patent Application No. 105128162, 3 pages.

Office Action (English Translation) dated Jul. 18, 2017 in Korean Patent Application No. 10-2016-0112084, 8 pages.

First Action Interview Pilot Program Pre-Interview Communication dated Aug. 31, 2017 in U.S. Appl. No. 15/476,829, 4 pages.

Evaluation Report for Utility Model Patent (English Translation) dated Sep. 13, 2017 in Chinese Patent Application No. ZL2016210423187, 19 pages.

Office Action dated Oct. 24, 2017 in European Patent Application No. 16186530.8, 9 pages.

* cited by examiner

LOW-PROFILE SPRING-LOADED CONTACTS

CROSS-REFERENCES TO RELATED APPLICATIONS

This application is a nonprovisional of United States provisional patent application No. 62/215,592, filed Sep. 8, 2015, which is incorporated by reference.

BACKGROUND

The number of types of electronic devices that are commercially available has increased tremendously the past few years and the rate of introduction of new devices shows no signs of abating. Devices, such as tablet, laptop, netbook, desktop, and all-in-one computers, cell, smart, and media phones, storage devices, portable media players, navigation systems, monitors, and others, have become ubiquitous.

Power and data may be provided from one device to another over cables that may include one or more wire conductors, fiber optic cables, or other conductor. Connector inserts may be located at each end of these cables and may be inserted into connector receptacles in the communicating or power transferring devices. In other systems, contacts on the devices may come into direct contact with each other without the need for intervening cables.

In systems where contacts on two electronic devices come into direct contact with each other, it may be difficult to generate enough normal force to ensure a good electrical connection between contacts in the two devices. To provide a sufficient normal force, contacts may often have a substantial depth and consume a relatively large volume of space in the electronic device. The loss of this space may mean that the electronic device is either larger or only includes a reduced set of functionality.

These electronic devices may be manufactured in large numbers. A corresponding number of contact structures may be manufactured for use in these devices. Any simplification in the manufacturing process of these contact structures may yield tremendous savings in the manufacturing of these electronic devices.

Thus, what is needed are contact structures that are readily manufactured, where contacts in the contact structures provide a sufficient normal force while consuming a minimal amount of surface area, depth, and volume in an electronic device.

SUMMARY

Accordingly, embodiments of the present invention may provide contact structures that are readily manufactured, where contacts in the contact structures provide a sufficient normal force while consuming a minimal amount of surface area, depth, and volume in an electronic device.

An illustrative embodiment of the present invention may provide contact structures that may provide movable contacts at a surface of an electronic device. The contact structures may include a nonconductive housing supporting one, two, three, or more conductive contacts. Each contact may be located at an end of a flexible lever arm, where a remote end of the arm may be fixed to the housing. The contacts may have contacting portions that emerge from corresponding openings in the housing.

These contact structures may be manufactured in various ways. For example, the contacting portions may be attached to ends of the flexible lever arms by riveting, soldering, or the contacting portions and the flexible lever arms may be formed as a single piece. The contacting portions may be formed of the same or different materials. For example, the contacting portions may be formed of a material that provides a low resistance and low corrosion, while the flexible lever arms may be formed of a material chosen for its flexibility and its ability to withstand fatigue and cold-working. The contacting portion may have a narrowed tail extending from a wider body, where the narrowed tail may be inserted into an opening at an end of the flexible lever arm. The narrowed tail may extend through and beyond the flexible lever arm. Force may be applied to the narrowed tail causing it to expand outward, for example in a riveting process. The contacting portion may be held in place in the opening on the flexible lever arm on one side by the expanded narrowed tail and on the other side by the wider body. Each flexible lever arm may have a surface-mount contacting portion at an end remote from the contacting portion. Each flexible lever arm may further include a barb to be inserted into a notch or groove in the contact structure housing. In other embodiments of the present invention, one or more contacts, such as the center contact, may have the housing insert molded around it such that it does not require a barb. The contacts may be arranged in a line in the housing, though they may be arranged in other patterns. Contacts that are centrally located in the housing may be inserted into the housing from a bottom side and fixed in place by inserting their barbs into slots or grooves in the housing. Again, in other embodiments of the present invention these center contacts may have the housing insert molded around it. Support structures may be placed under the contacting portions of the central contacts to limit their travel such that they cannot be pushed all the way into the housing, though these may not be useful when the housing is insert molded around the center contact. Contacts located at the ends may be slid into the housing using slots in the housing. The side contacts may also be fixed in place by inserting their barbs into slots or grooves in the housing. Insulating tape may be used to electrically insulate the housing. A cover having openings for the contacting portions may be fit over the housing. The cover may have a raised portion around the openings for the contacts to fit in an opening of a device enclosure of the electronic device housing the contact structure.

Another illustrative embodiment of the present invention may provide contact structures that may provide movable contacts at a surface of an electronic device. The contact structures may include a nonconductive housing having slots for a number of conductive contacts. Each contact may include a contacting portion attached to a flexible lever arm. The flexible lever arm may attach to a contact length that may be located in a slot in the housing. A cover may fit over the housing. The cover may include a raised portion having a number of openings, each opening for a corresponding contacting portion of a contact. The openings may be located in raised portion. The raised portion may fit in an opening of a device enclosure of the electronic device housing the contact structure. The contact structure may further include a bottom plate. The bottom plate may include side tabs that fit in notches or slots in sides of the housing and cover to fix the cover and housing in place relative to the bottom plate.

Another illustrative embodiment of the present invention may provide contact structures that may provide movable contacts at a surface of an electronic device. This contact structure may include a nonconductive housing supporting one, two, three, or more conductive contacts. Each contact may be a spring-biased contact. The spring-biased contacts may have contacting portions that emerge from corresponding openings in the housing.

These contact structures may be manufactured in various ways. For example, the spring-biased contacts may be attached to a flexible circuit board. Terminal contacts on the spring-biased contacts may be soldered into opening in the flexible circuit board. A layer of double-sided adhesive may be used to fix the flexible circuit board to a bracket. Threaded inserts may be placed in one or more openings in the bracket, or the ends of the brackets may include threaded openings. For example, the threaded inserts may be press-fit into openings near ends of the bracket. A cap may be formed where the cap may include openings for contacting portions of the spring-biased contacts. The openings may be located on a raised portion that may be arranged to fit in an opening of a device enclosure of the electronic device housing the contact structure. The cap may include gaskets that form rings around the contacting portions of the spring-biased contacts between the contacting portions and inside edges of the openings in the raised portion of the cap. The cap may be formed as a double-shot injection molded part where the gaskets are the second injection-molded shot. The cap may be fixed to the flexible circuit board using a double-sided adhesive layer. A lid, which may be part of a device enclosure for the device housing the contact structure, may be fixed over the top of the contact structure by screws or other fasteners that may be fit into openings in the lid and inserted into the threaded inserts. The raised portion of the cap may fit into a central opening in the lid. A gasket may be placed around the raised portion of the cap and between the cap and the lid to prevent the ingress of liquid, moisture, debris, or other substances into the electronic device housing the contact structure.

The spring-biased contacts may be formed in various ways. For example, a housing have a central hole may be provided. A spring may be fit into the central hole. A contacting portion having a backside opening may be fit over the spring such that one end of the spring is in the central hole of the housing and the other end of the spring is in the backside opening of the contacting portion. A terminal structure may be fit over the contacting portion and top of the housing. A tab on the contacting portion may be under the terminal structure such that the contacting portion is held in place. Tabs on the terminal structure may fit in notches or slots in the housing to secure the terminal structure in place relative to the housing. The terminal structure may include through-hole portions that may be inserted and soldered in place in openings in the flexible circuit board.

Embodiments of the present invention may provide contact structures that may be located in various types of devices, such as portable computing devices, tablet computers, desktop computers, laptops, all-in-one computers, wearable computing devices, cell phones, smart phones, media phones, storage devices, keyboards, covers, cases, portable media players, navigation systems, monitors, power supplies, adapters, remote control devices, chargers, and other devices. These contact structures may provide pathways for signals and power compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In one example, the contact structures may be used to convey a data signal, a power supply, and ground. In various embodiments of the present invention, the data signal may be unidirectional or bidirectional and the power supply may be unidirectional or bidirectional.

Various embodiments of the present invention may incorporate one or more of these and the other features described herein. A better understanding of the nature and advantages of the present invention may be gained by reference to the following detailed description and the accompanying drawings.

DESCRIPTION OF EXEMPLARY EMBODIMENTS

Figure 1:
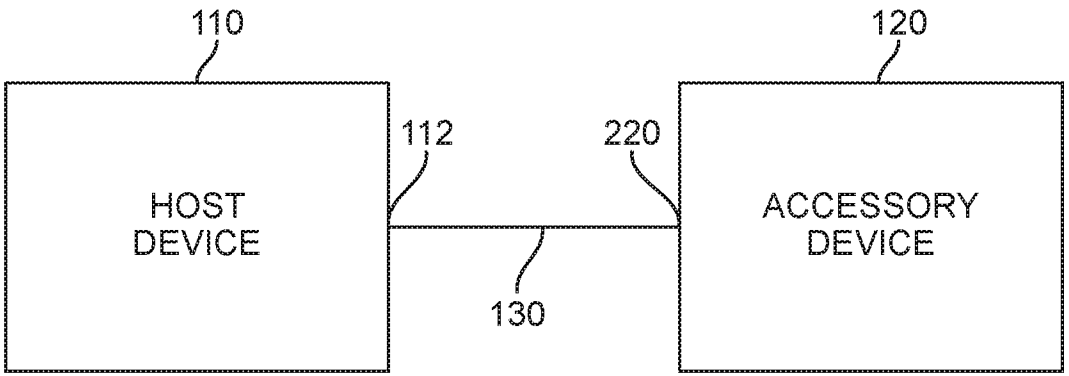
FIG. 1 illustrates an electronic system according to an embodiment of the present invention.

FIG. 1 illustrates an electronic system according to an embodiment of the present invention. This figure, as with the other included figures, is shown for illustrative purposes and does not limit either the possible embodiments of the present invention or the claims.

In this example, host device 110 may be connected to accessory device 120 in order to share data, power, or both. Specifically, contacts 112 on host device 110 may be electrically connected to contacts 220 on accessory device 120. Contacts 112 on host device 110 may be electrically connected to contacts 220 on accessory device 120 via cable 130. In other embodiments of the present invention, contacts 112 on host device 110 may be directly and electrically connected to contacts 220 on accessory device 120.

To facilitate a direction connection between contacts 112 on host device 110 and contacts 220 on accessory device 120, contacts 220 may be part of a surface-mount contact structure. An example of a surface-mount contact structure that may include contacts 220 is shown in the following figures.

Figure 2:
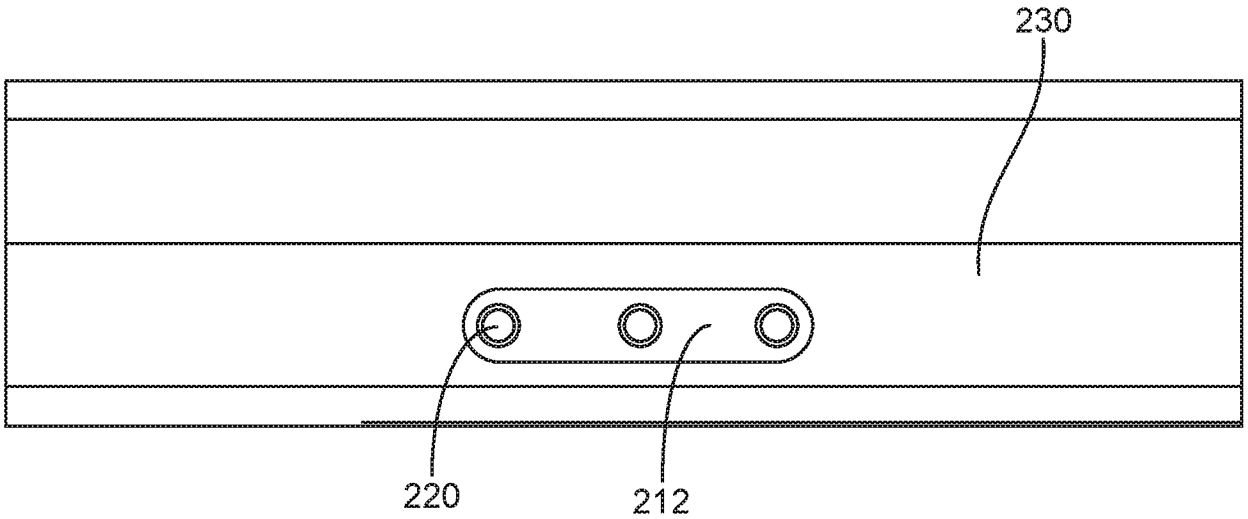
FIG. 2 illustrates a contact structure in a device enclosure according to an embodiment of the present invention.

FIG. 2 illustrates a contact structure in a device enclosure according to an embodiment of the present invention. In this example, a raised portion 212 of a contact structure may be placed in an opening in device enclosure 230. The raised portion 212 of the contact structure may include openings for a number of contacts 220.

Contacts 220 may be low-profile contacts. Such contacts may allow a contact structure to provide contacts for a connector without consuming a large volume in the electronic device housed by enclosure 230. In various embodiments the present invention, contacts 220 may be spring-biased contacts. For example, contacts 220 may be biased by a spring, flexible arm, or other flexible structure such that they may be pushed or depressed and may return to their original position once released. Spring-biased contacts may provide an amount of compliance with contacts in a corresponding connector, thereby assisting in forming electrical connections between multiple contacts 220 and corresponding contacts of a second connector on a second device (not shown.)

Accordingly, embodiments of the present invention may provide contact structures having low-profile, spring-biased contacts. An example is shown in the following figure.

Figure 3:
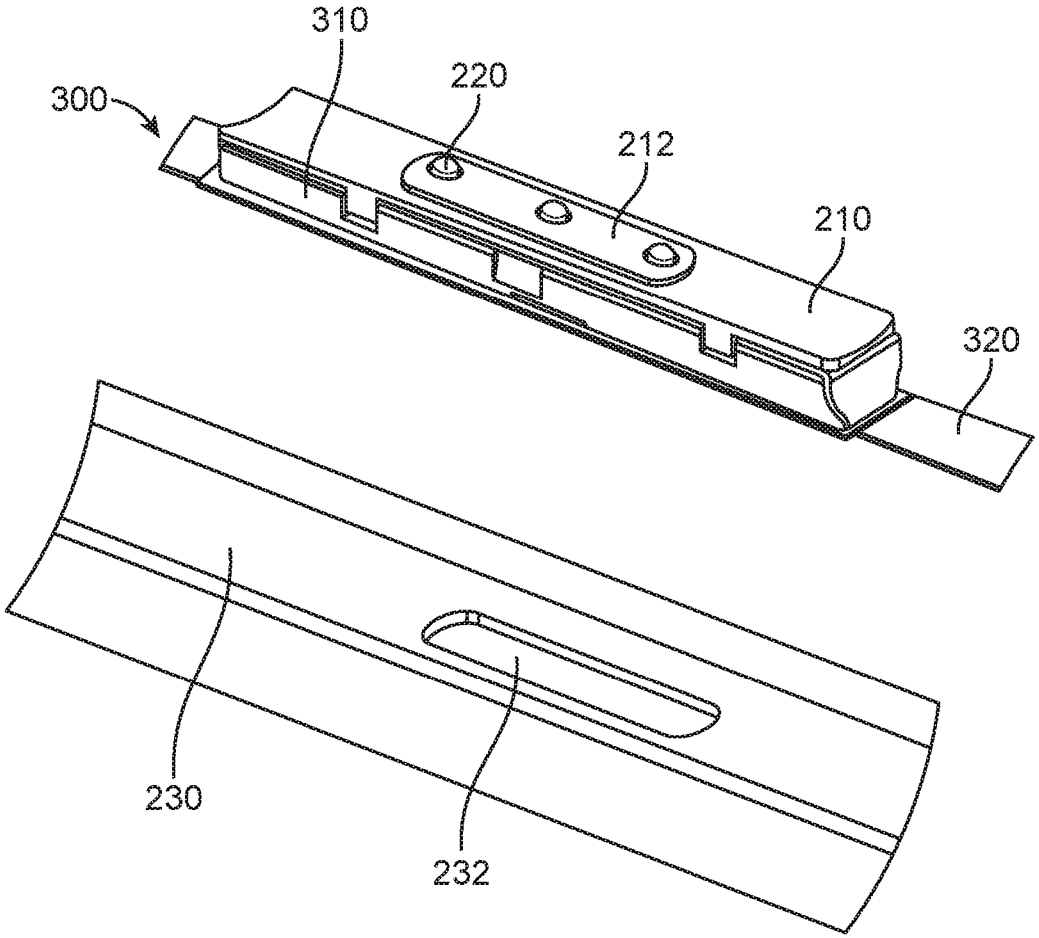
FIG. 3 illustrates a portion of an electronic device according to an embodiment of the present invention.

FIG. 3 illustrates a portion of an electronic device according to an embodiment of the present invention. This figure illustrates a contact structure 300 having a raised portion 212 on a cover 210 that is fit on a top side of housing 310. Raised portion 212 may be arranged to fit an opening 232 in device enclosure 230. Contact structure 300 and may support a number of contacts 220 each in openings in raised portion 212. Contacts 220 may emerge from bottom of housing 300 and be connected to interconnect 320.

In this example, contact structure 300 may include three contacts 220. In other embodiments of the present invention, contact structure 300 may include one, two, or more than three contacts 220. Also, while in this example each of the contacts 220 are located in a single raised portion 212, in other embodiments of the present invention, more than one raised portion 212 may be employed, and one or more contact 220 may be located in portions of contact structure 300 other than the one or more raised portions 212. Also, while the three contacts 220 are shown as being in a line, in other embodiments of the present invention, contacts 220 may be arranged in other patterns.

Figure 4:
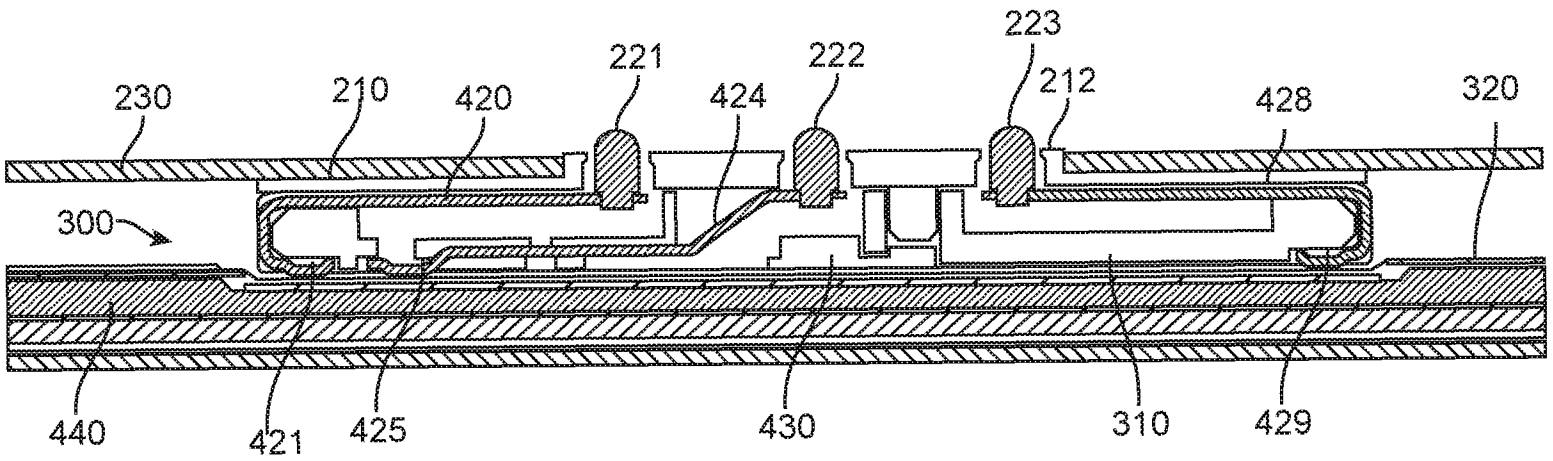
FIG. 4 illustrates a side view of a contact structure according to an embodiment of the present invention.

FIG. 4 illustrates a side view of a contact structure according to an embodiment of the present invention. Contact structure 300 may be located in an electronic device having housing 230. As before, raised portion 212 of cover 210 of contact structure 300 may be located in an opening in device enclosure 230. Housing 310 of contact structure 300 may support contacts having contacting portions 221, 222, and 223. These contacting portions 221, 222, and 223 may be attached to ends of flexible lever arms 420, 424, and 428. Each flexible arm may terminate in a second end and may include a barb, which may be inserted into notches or grooves in housing 310. Specifically, flexible lever arm 420 may include barb 421, flexible lever arm 424 may include barb 425, and flexible lever arm 428 may include barb 429. In other embodiments of the present invention, the center contact may have housing 310 insert molded around it and barb 425 may not be needed.

During assembly, the central contact including contact portion 222 may be inserted through an opening in a bottom of housing 210. Without more, contacting portion 222 could be pushed deep into housing 310. In some instances, contacting structure 222 could be pushed below cover 210. If contacting portion 222 were to be laterally offset at this time, contacting portion 222 may not emerge from its opening in cover 210. Accordingly, a bottom stop portion 430 may be located under contacting portion 420. Bottom stop portion 430 may limit a depth to which contacting portion 222 may be depressed, thereby preventing possible damage to contact structure 300. In other embodiments of the present invention, the center contact may have housing 310 insert molded around it such that bottom stop portion 430 may not be needed.

Contacts structure 300 may be formed in various ways. An example is shown in the following figure.

Figure 5:
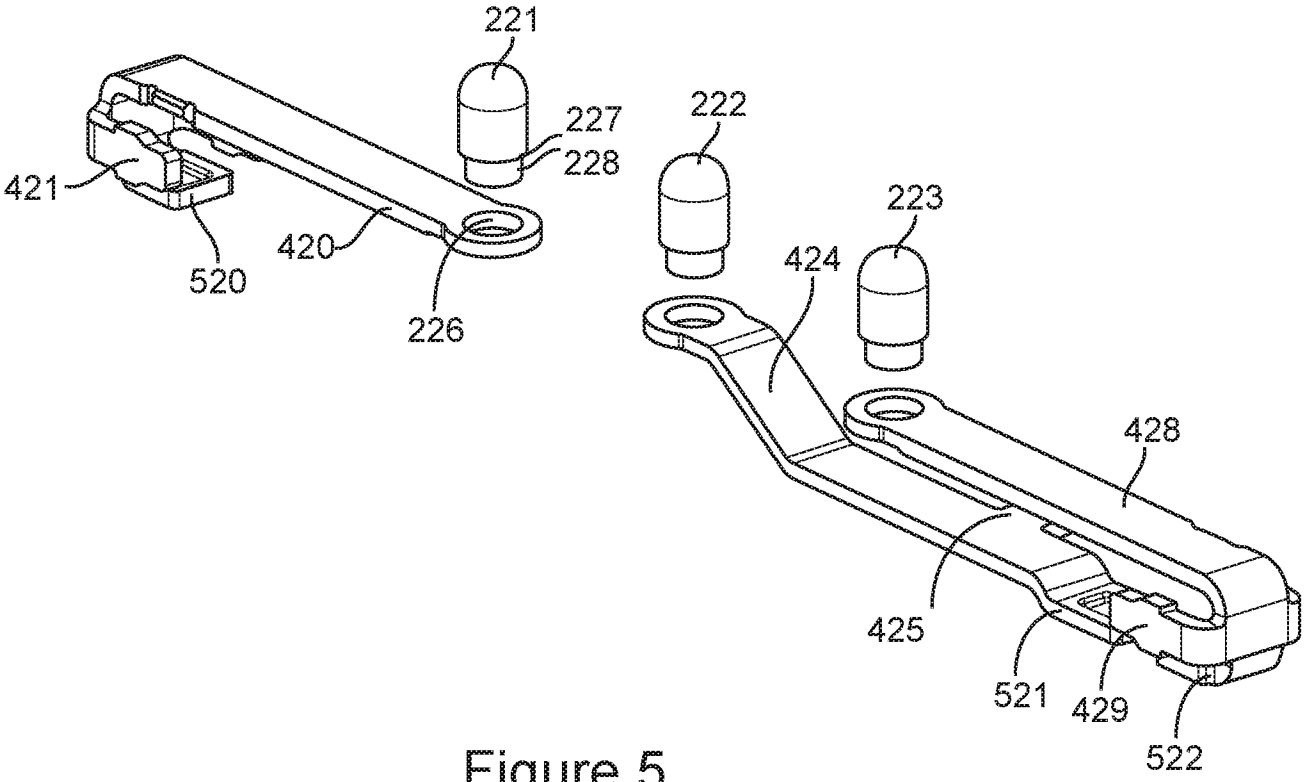
FIGS. 5-11 illustrate a method of assembling a contact structure according to an embodiment of the present invention.

FIGS. 5-11 illustrate a method of assembling a contact structure according to an embodiment of the present invention. In FIG. 5, contacts for a contact structure according to an embodiment of the present invention, such as contact structure 300, may be formed. These contacts may include contacting portions 221, 222, and 223. Ends of contacting portions 221, 222, and 223 may be attached to flexible lever arms 420, 424, and 428. Flexible lever arm 420 may terminate in a first barb 421 and include a surface-mount contact portion 520. Flexible lever arm 424 may include barb 425 and may terminate in surface-mount contacting portion 521. Flexible lever arm 428 may include barb 429 and may terminate in surface-mount contacting portion 522. In other embodiments of the present invention, the center contact may have housing 310 insert molded around it and barb 425 may not be needed.

Contacting portions 221, 222, and 223 may be riveted to flexible lever arms 420, 424, and 428. Specifically, contacting portion 221 may include a narrowed tail portion 228 below ledge 227. Narrowed end portion 228 may be inserted into opening 236 in flexible lever arm 420. Ledge 227 may rest on a top surface of flexible lever arm 420 around opening 226. Narrowed end 228 may have a force applied such that it widens, for example, by riveting. In this way, contacting portion 221 may be secured to flexible arm 420 by ledge 427 and the widened portion of narrowed tail 228. When contacting structure 300 is mounted on a board or other appropriate substrate, surface-mount contacting portions 520, 521, and 522 may be soldered to contacts on the board thereby forming interconnect path from contacting portions 221, 222, and 223 to interconnect traces on the board.

Figure 6:
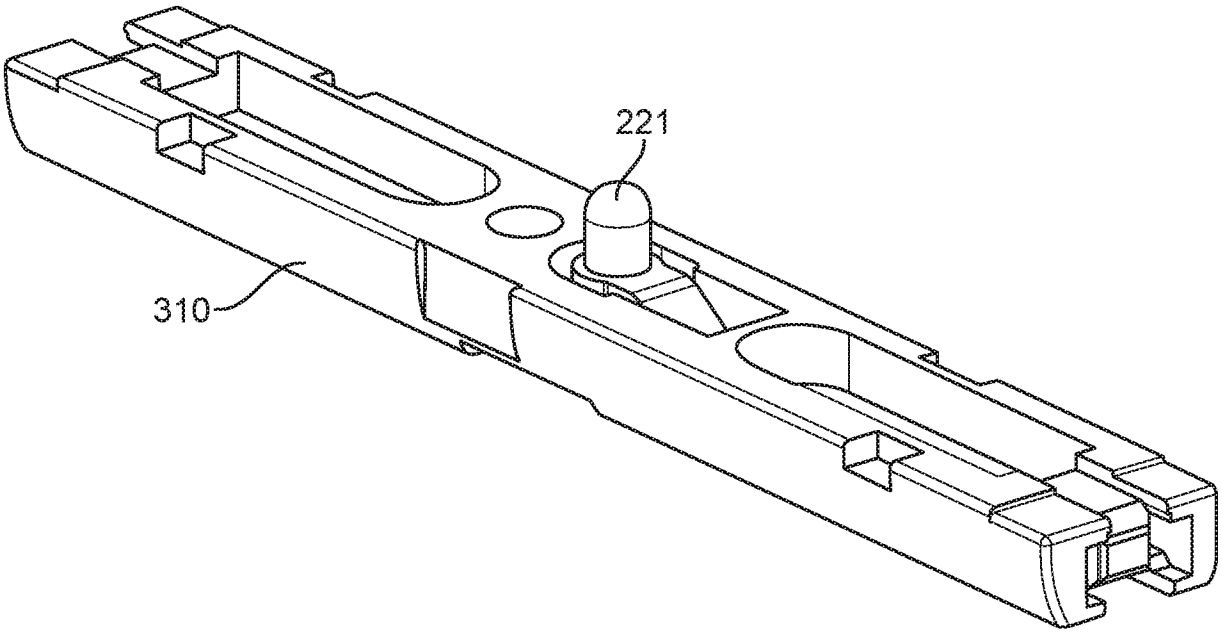

In FIG. 6, a central contact including contacting portion 221 may be inserted through an opening in a bottom of housing 210. At least some of contacting portion 221 may emerge from a top surface of housing 310. In other embodiments, housing 310 may be insert molded around the central contact.

Figure 7:
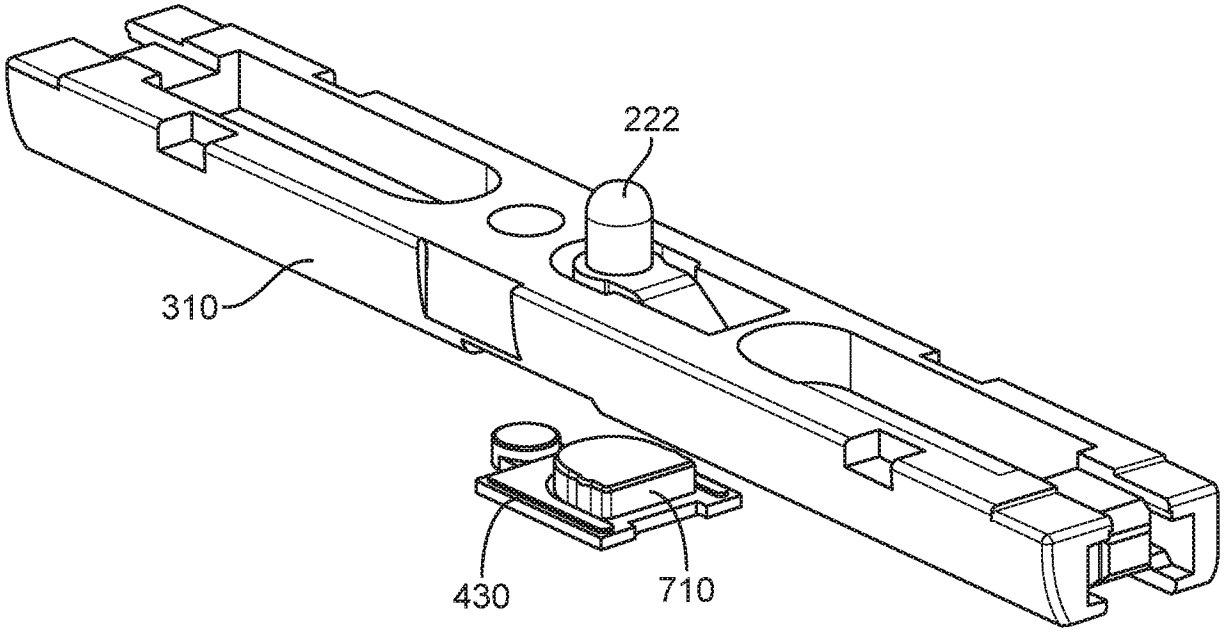

In FIG. 7, central contact 221 has inserted through a bottom opening in housing 210. Since central contact 221 is inserted through a bottom opening in housing 210, central contacting portion 221 could inadvertently be pushed all the way to the bottom of housing 310. To prevent this, embodiments of the present invention may attach a bottom stop portion 430 to a bottom of housing 310. Bottom stop portion 430 may include a raised portion 710 below contacting portion 221. This raised portion 710 may restrict the travel range of contacting portion 221. This may prevent contacting portion 221 be pushed all the way into housing 310, thereby damaging contacting structure 300. In other embodiments of the present invention, the center contact may have housing 310 insert molded around it and bottom stop portion 430 may not be needed.

Figure 8:
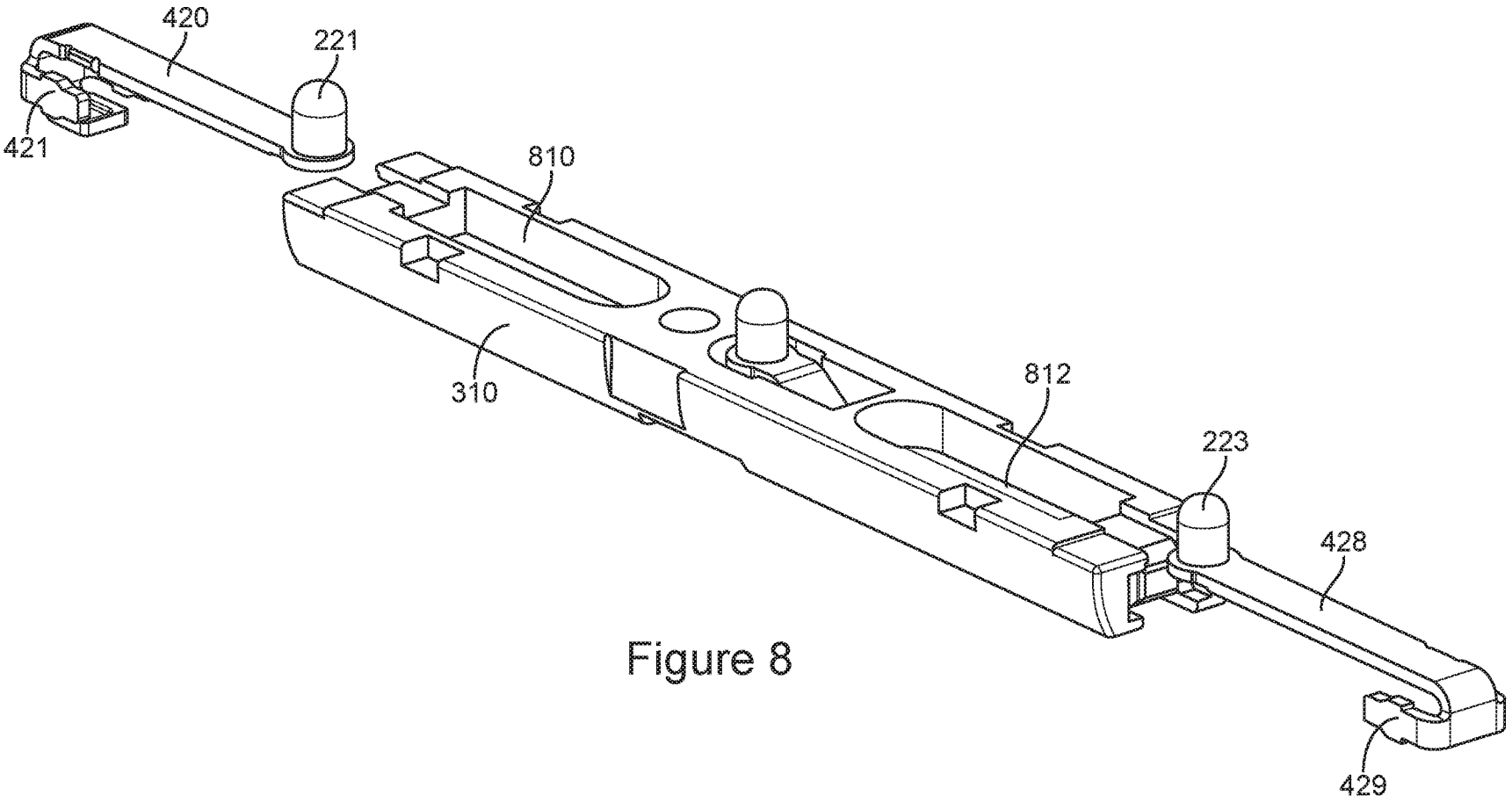

In FIG. 8, side contacts including contacting portions 221 and 223 may be inserted into housing 310 using slots 810 and 812. Flexible lever arm 420 may be pushed into housing 310 until barb 421 is inserted into a groove or notch in housing 210. Similarly, flexible lever arm 428 may be pushed into housing 310 until barb 428 is inserted into a groove or notch in housing 310.

Figure 9:
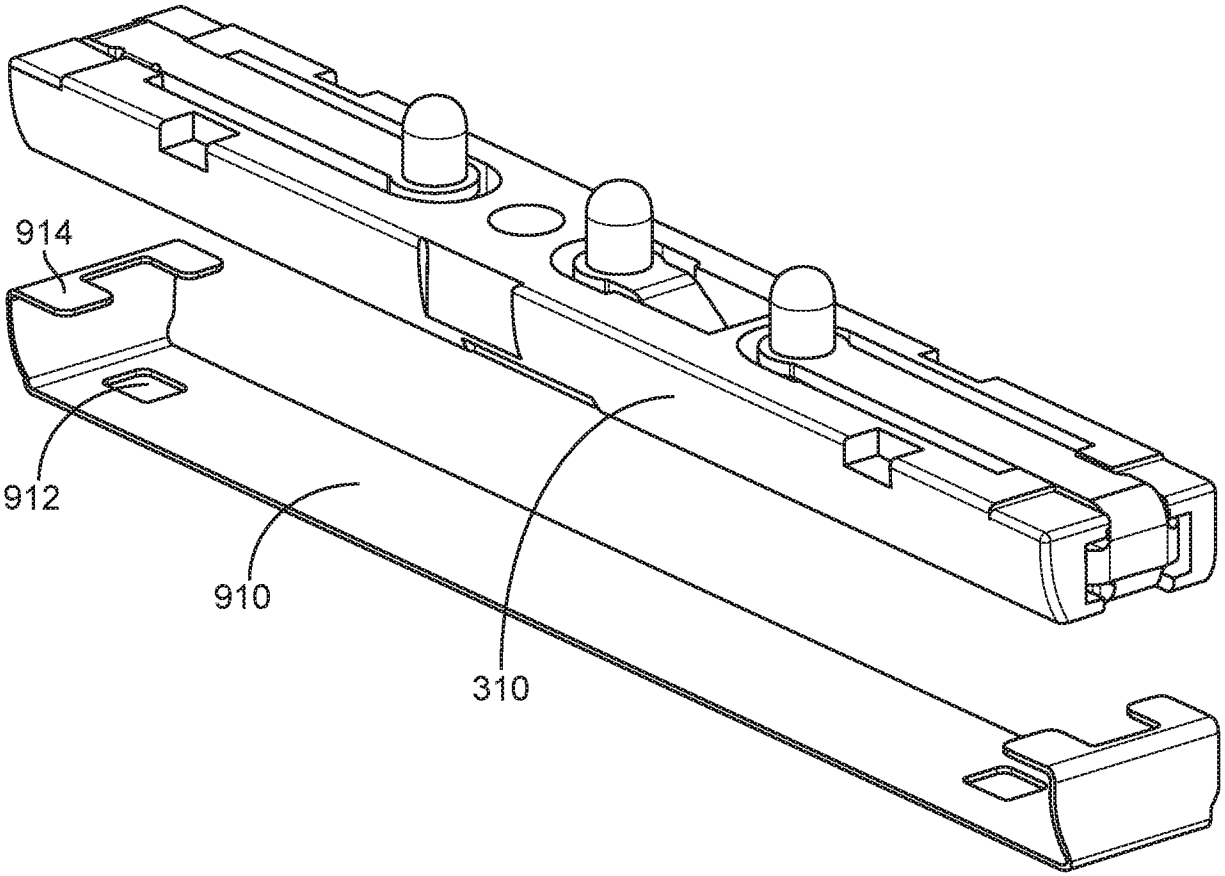

In FIG. 9, a piece of insulating tape 910 may be wrapped around a portion of the top, sides, and bottom of housing 310. Insulating tape 910 may include openings 912 for surface-mount contacting portions 520, 521, and 522 of the contacts in housing 310. Insulating tape 910 may include top surface tabs 914. Top surface tabs 914 may be sandwiched between top cover 210 and housing 310, thereby helping to maintain insulating tape 910 in place. In various embodiments of the present invention, insulating tape 910 may be Mylar tape or other type of tape or insulating layer.

Figure 10:
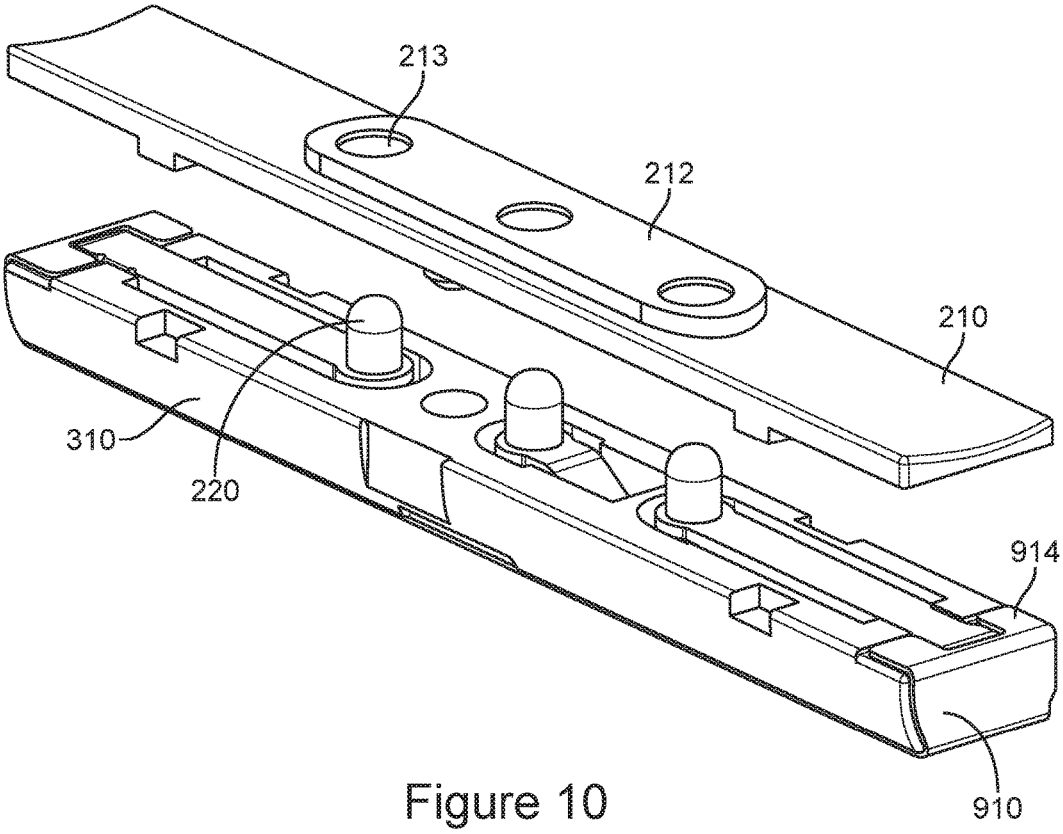

In FIG. 10, a cover 210 may be placed over housing 310. Again, top surface tabs 914 of insulating tape 910 may be placed between top cover 310 and housing 310, thereby holding insulating tape 910 in place. Top cover 210 may include a raised portion 212 having openings 213 for contacts 220.

Figure 11:
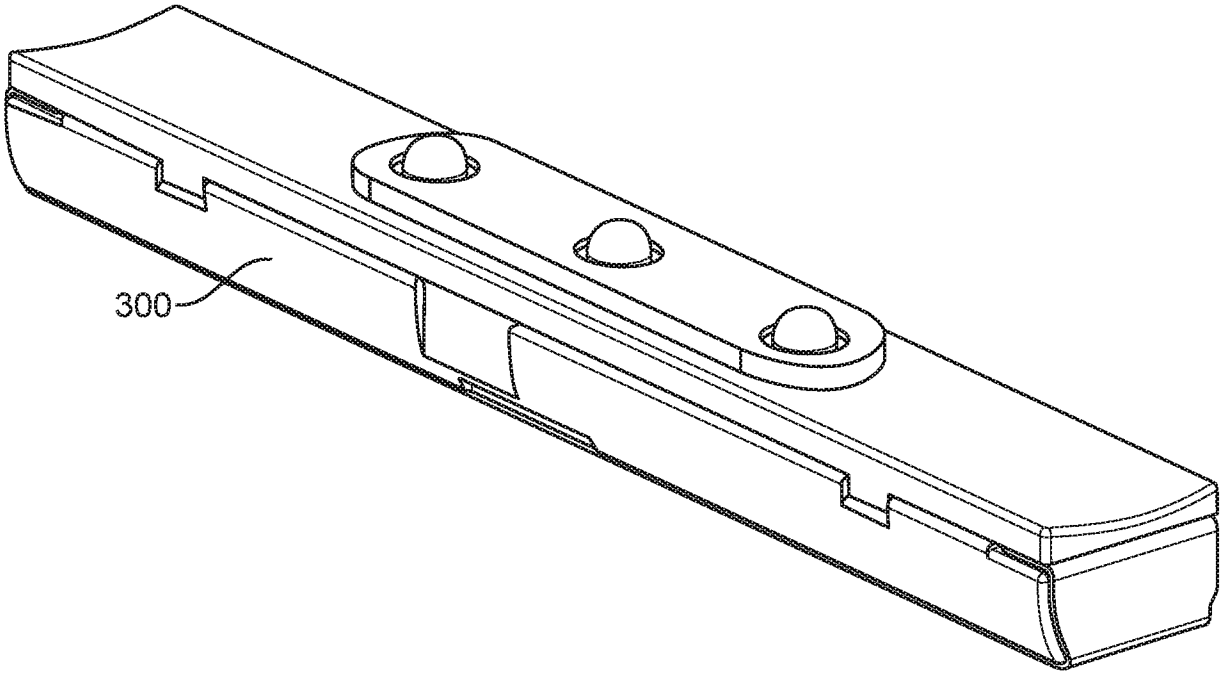

FIG. 11 illustrates a completed contact structure 300 according to an embodiment of the present invention.

In various embodiments of the present invention, different portions of contact structure 300 and other contact structures may be formed of various materials. For example, housing 310 and cover 210 may be formed of the same or different materials, such as plastic, LPS, or other non-conductive material. Contacting portions 221, 222, and 223, may be formed of noncorrosive materials, such as gold, gold plated copper, gold plated nickel, gold-nickel alloy, and other materials. Flexible lever arms 420, 444, and 428 may be formed of spring metal, sheet-metal, copper alloy, or other complaint material.

In various embodiments of the present invention, different portions of contact structure 300 and other contact structures may be formed in various ways. For example, housing 310 and cover 210 may be formed using injection or other molding, printing, or other technique Contact portions 221, 222, and 223 and flexible lever arms 420, 424, and 428 may be machined, stamped, coined, forged, printed, or formed in different ways. Contact portions 221, 222, and 223 may be attached to flexible lever arms 420, 424, and 428 by riveting, soldering, spot-welding, or other technique, or they may be formed as a single unit. Housing 310 and cover 210 may be formed around contacts 220 using injection molding.

Figure 12:
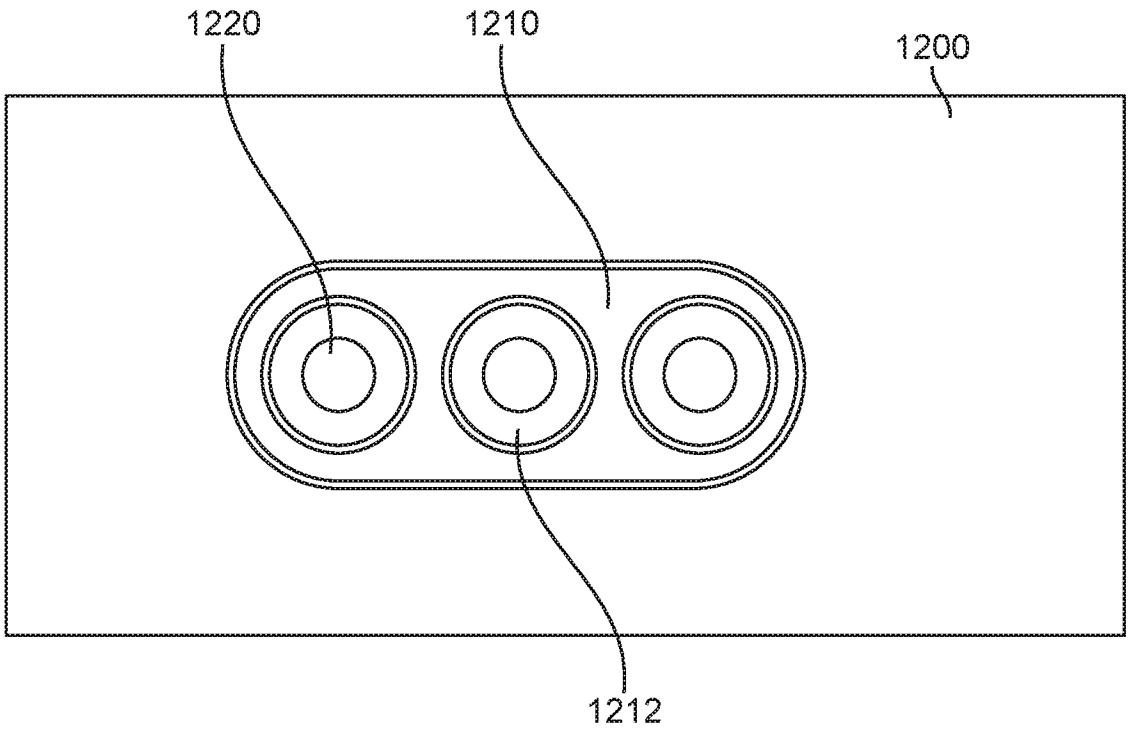
FIG. 12 illustrates another contact structure in a device enclosure according to an embodiment of the present invention.

FIG. 12 illustrates another contact structure in a device enclosure according to an embodiment of the present invention. In this example, a raised portion 1210 of a contact structure may be fit in an opening in device enclosure 1200. Raised portion 210 may include contacts 1220 each surrounded by an individual raised portion 1212.

Contacts 1220 may be low-profile contacts. Such contacts may allow a contact structure to provide contacts for a connector without consuming a large volume in the electronic device housed by enclosure 1200. In various embodiments the present invention, contacts 1220 may be spring-biased contacts. For example, contacts 1220 may be biased by a spring, flexible arm, or other flexible structure such that they may be pushed or depressed and may return to their original position once released. Spring-biased contacts may provide an amount of compliance with contacts in a corresponding connector, thereby assisting in forming electrical connections between multiple contacts 1220 and corresponding contacts of a second connector on a second device (not shown.)

Accordingly, embodiments of the present invention may provide contact structures having low-profile, spring-biased contacts. An example is shown in the following figure.

Figure 13:
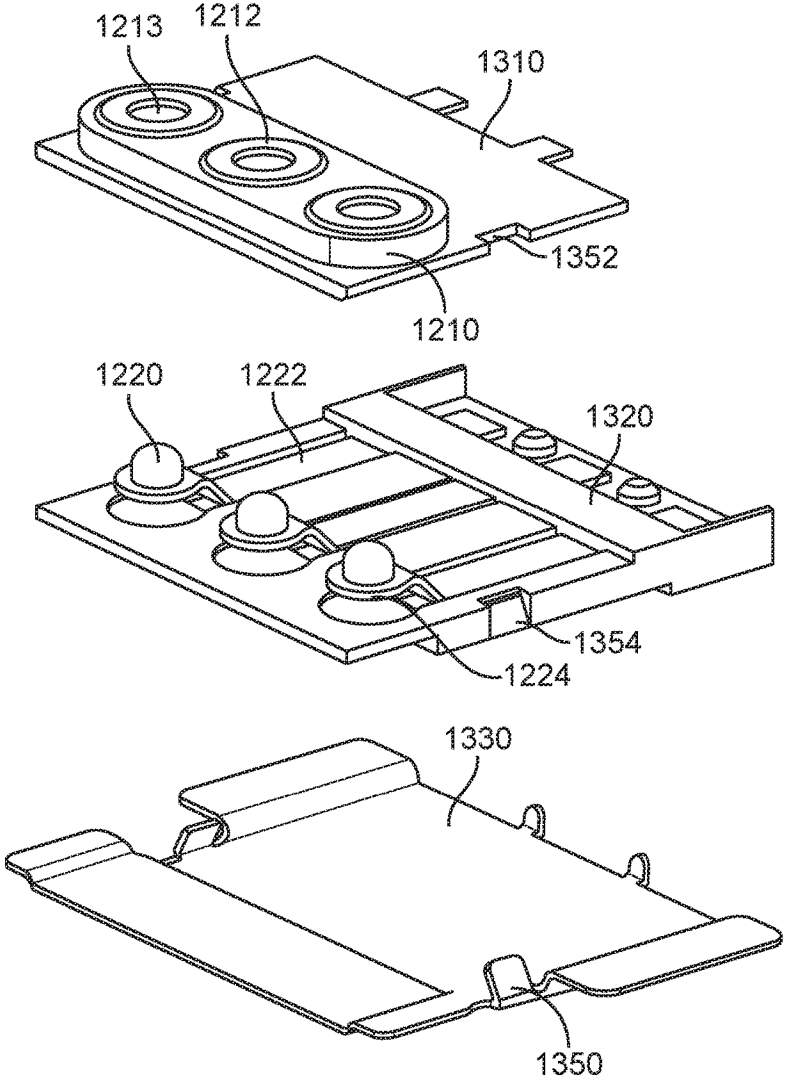
FIG. 13 illustrates a contact structure according to an embodiment of the present invention.

FIG. 13 illustrates a contact structure according to an embodiment of the present invention. This contact structure may include housing 1320 having a number of slots for contact portions 1222. Contact portions 1222 may connect to contacting portions 1220 via flexible arms 1224.

This contact structure may further include a top plate or cover 1310 having a raised portion 1210. Raised portion 1210 may include further raised portions 1212 around each opening 1213. Each opening 1213 may allow a connection to be made to contacting portion 1220.

This contact structure may further include a bottom plate 1330. Bottom plate 1330 may include tabs 1350 to fit in notch 1352 in top plate or cover 1310 and notch 1354 in housing 1320 to secure top plate or cover 1310, housing 1320, and bottom plate 1330 together as a unit.

In various embodiments of the present invention, different portions of this contact structure and other contact structures may be formed of various materials. For example, housing 1320, cover 1310, and bottom plate 1330 may be formed of the same or different materials, such as plastic, LPS, or other non-conductive material. Contacting portions 1220 may be formed of noncorrosive materials, such as gold, gold plated copper, gold plated nickel, gold-nickel alloy, and other materials. Flexible lever arms 1224 and contact portions 1222 may be formed of spring metal, sheet-metal, copper alloy, or other complaint material.

In various embodiments of the present invention, different portions of this contact structure and other contact structures may be formed in various ways. For example, housing 1320, cover 1310, and bottom plate 1330 may be formed using injection or other molding, printing, or other technique Contacting portions 1220, flexible lever arms 1224, and contact portions 1222 may be machined, stamped, coined, forged, printed, or formed in different ways. Contact portions 1220 may be attached to flexible lever arms 1224 by riveting, soldering, spot-welding, or other technique, or they may be formed as a single unit. Housing 1320, cover 1310, and bottom plate 1330 may be formed around contacts 1220 using injection molding.

Figure 14:
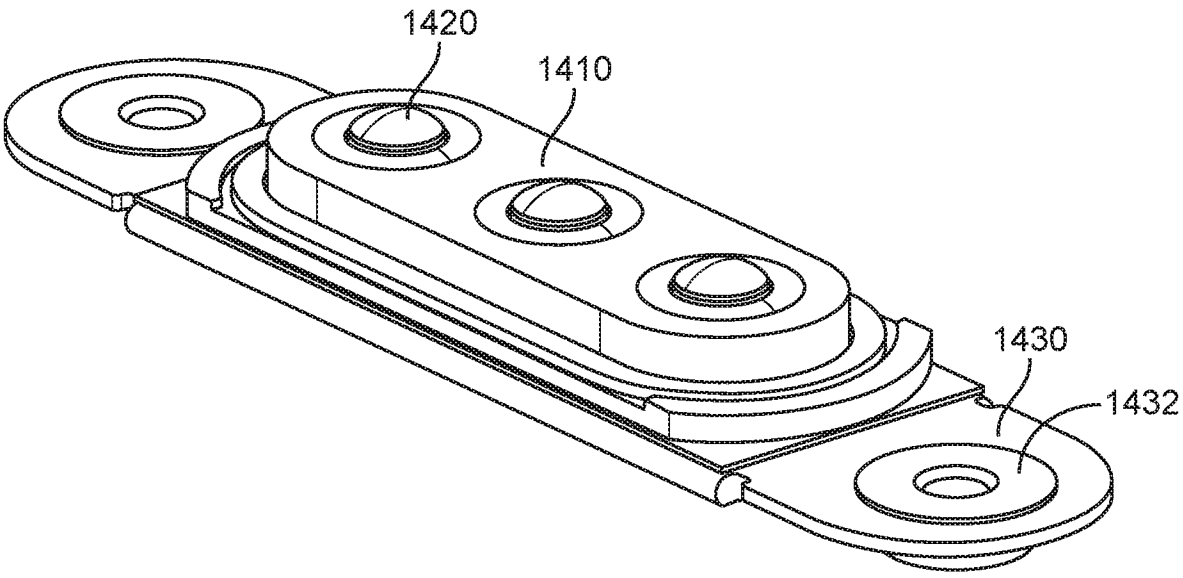
FIG. 14 illustrates a contact structure in a device enclosure according to an embodiment of the present invention.

FIG. 14 illustrates a contact structure in a device enclosure according to an embodiment of the present invention. In this example, a raised portion 1410 of a contact structure may be fit in an opening in a device enclosure. Raised portion 1410 may include contacts 1420. This contact structure may include bracket 1430. Bracket 1430 may be fixed to a lid, device enclosure, or other structure by inserting fasteners into threaded inserts 1432.

Contacts 1420 may be low-profile contacts. Such contacts may allow a contact structure to provide contacts for a connector without consuming a great deal of volume in the electronic device housed by the enclosure. In various embodiments the present invention, contacts 1420 may be spring-biased contacts. For example, contacts 1420 may be biased by a spring, flexible arm, or other flexible structure such that they may be pushed or depressed and may return to their original position once released. Spring-biased contacts may provide an amount of compliance with contacts in a corresponding connector, thereby assisting in forming electrical connections between multiple contacts 1420 and corresponding contacts of a second connector on a second device (not shown.)

This contact structure may be assembled in various ways. An example is shown in the following figure.

Figure 15:
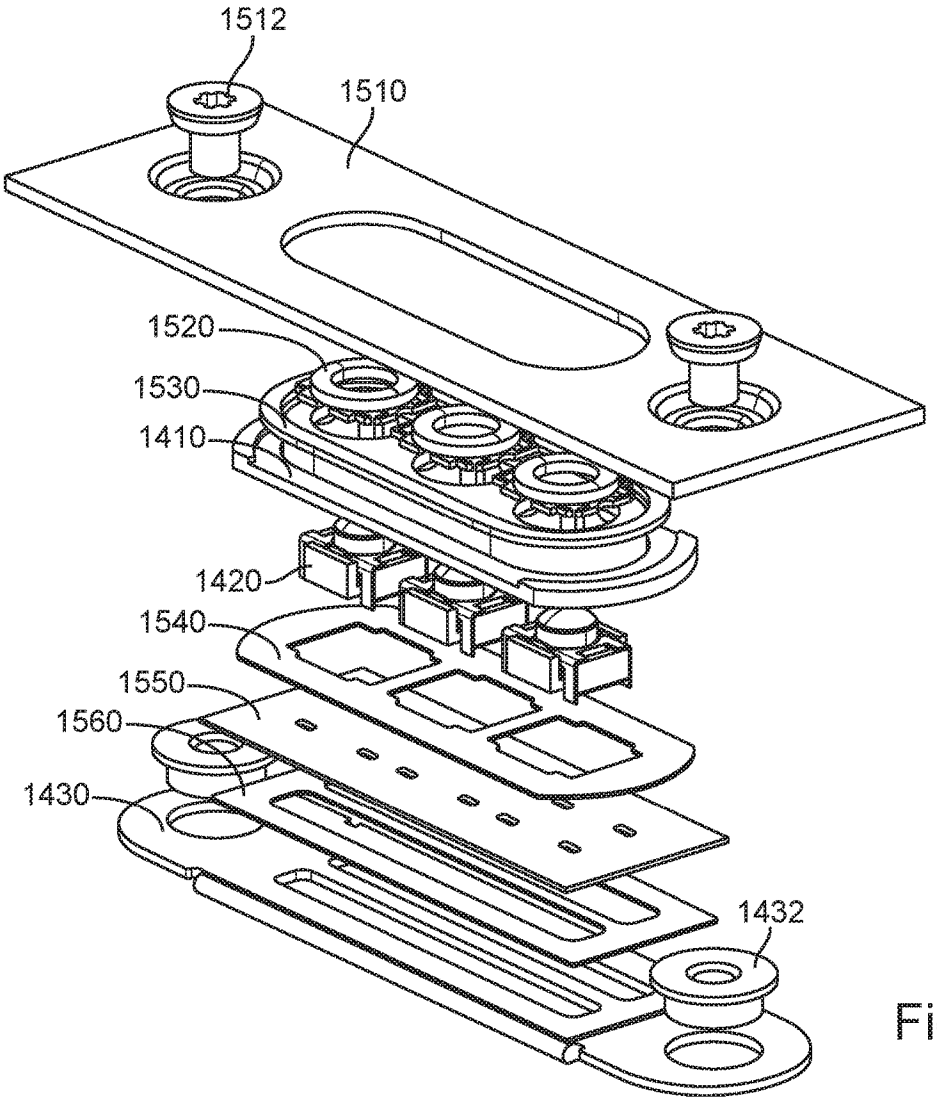
FIG. 15 is an exploded view of a contact structure according to an embodiment of the present invention.

FIG. 15 is an exploded view of a contact structure according to an embodiment of the present invention. In this example, a flexible circuit board 1550 may include a number of openings for terminals of spring-biased contacts 1420.

Spring-biased contacts 1420 may be attached to flexible circuit board 1550 by inserting terminals of spring-biased contacts 1420 into the openings in flexible circuit board 1550 and soldering. A cap 1410 having openings for contacts 1420 may be placed over contacts 1420. Cap 1410 may further include gaskets 1520 in openings in cap 1410. An additional gasket 1530 may be placed or formed between contacts 1420 and inside edges of openings in cap 1410. Gaskets 1520 and 1530 may be formed of silicone or other sealing material. Cap 1410 may be formed as a two shot injection molded process, where the main part of cap 1410 is formed in a first shot and gaskets 1520 are formed in a second shot. Cap 1410 may be attached to flexible circuit board 1550 using a double-sided adhesive layer 1540. Adhesive layer 1540 may be a heat activated film or adhesive layer. Bracket 1430 may be attached using a second adhesive layer 1560 to a bottom of flexible circuit board 1550. Adhesive layer 1560 may also be a heat activated film or adhesive layer. Lid 1510 may be placed over cap 1410. Lid 1510 may be a portion of a device enclosure for a device housing this contact structure. The enclosure may be conducive or nonconductive. Gasket 1530 may be placed around a raised surface of cap 1410 and be located between cap 1410 and lid 1510. Threaded inserts 1432 may be press-fit into openings at ends of bracket 1430. Fasteners, such as screws 1512, may be inserted into openings at ends of lid 1510 and screwed into threaded inserts 1432 in bracket 1430. In other embodiments of the present invention, the threaded inserts may be replaced by threaded opening in bracket 1430.

In this example, the contact structure may include three contacts 1420. In other embodiments of the present invention, the contact structure may include one, two, or more than three contacts 1420. Also, while in this example each of the contacts 1420 are located in a single raised portion, in other embodiments of the present invention, more than one raised portion may be employed, and one or more contact 1420 may be located in portions of the contact structure other than the one or more raised portions. Also, while the three contacts 1420 are shown as being in a line, in other embodiments of the present invention, contacts 1420 may be arranged in other patterns.

Various spring-biased contacts 1420 may be used in contacting structures according to embodiments of the present invention. An example is shown in the following figures.

Figure 16:
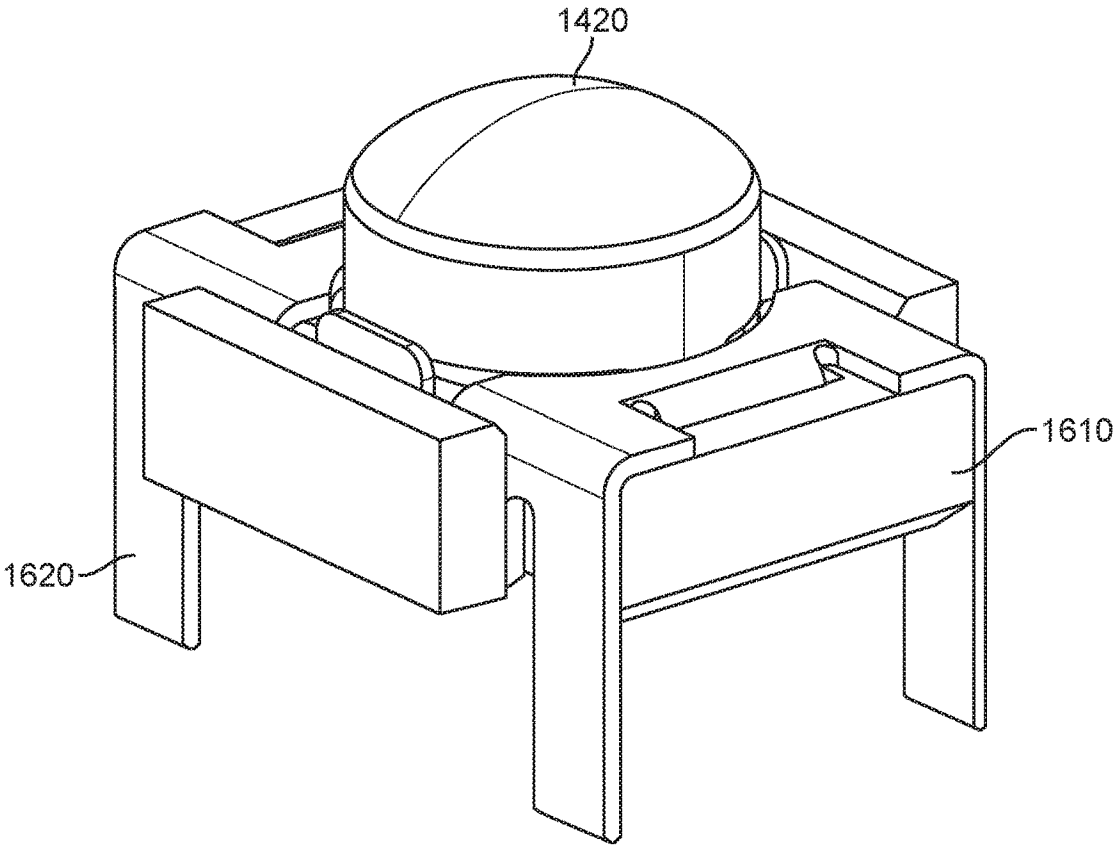
FIG. 16 illustrates a spring-biased contact according to an embodiment of the present invention.

FIG. 16 illustrates a spring-biased contact according to an embodiment of the present invention. This spring-biased contact may include a contacting portion 1420 supported by housing 1610. Terminal structure 1620 may include legs that may be inserted into openings in a flexible circuit board, printed circuit board, or other appropriate substrate.

Figure 17:
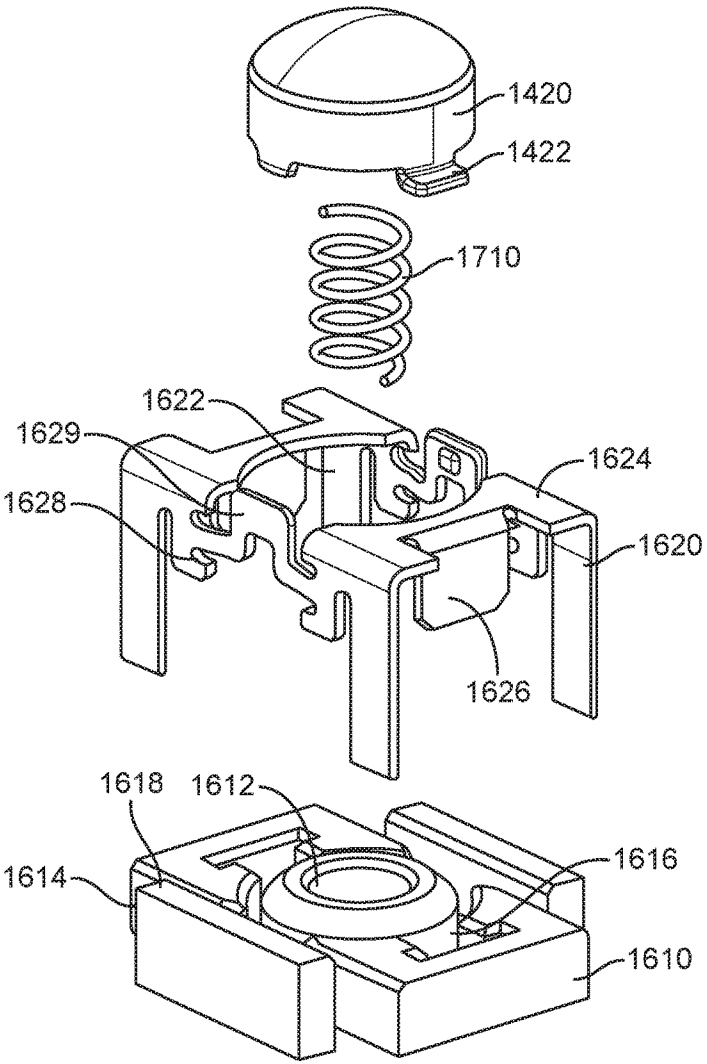
FIG. 17 is an exploded view of a spring-biased contact of FIG. 16.

FIG. 17 is an exploded view of a spring-biased contact of FIG. 16. In this example, housing 1610 may include a central opening 1612. A first end of spring 1710 may be inserted into central opening 1612. Housing 1610 may further include notches 1616 and 1618, as well as corner notches 1614.

A contacting portion 1420 may have a backside cavity (not shown.) A second end of spring 1710 may be inserted into the backside cavity of contacting portion 1420.

Terminal structure 1620 may be fit over contacting portion 1420 such that contacting portion 1420 passes through central opening 1622 of terminal structure 1620. Terminal structure 1620 may include legs which may fit in corner notches 1614. Tabs 1628 and 1626 may fit in notches 1618 and 1616 in housing 1610 to secure terminal structure 1620 in place relative to housing 1610. Contacting portion 1420 may include tabs 1422, which may fit under terminal structure 1620 near portion 1624 to hold contacting portion 1420 in place. Tabs 1628 may include raised portions 1629, which may fit in the back side cavity of contacting portion 1420. Tabs 1629 may help to ensure that electrical contact remains between contacting portion 1420 and terminal 1620 as the contacting portion 1420 is depressed towards housing 1610.

In various embodiments of the present invention, different portions of this contact structure and other contact structures may be formed of various materials. For example, cap 1410 and gaskets 1520 may be formed of the same or different materials, such as plastic, LPS, or other non-conductive material. Contacting portions of spring-biased contacts 1420 may be formed of noncorrosive materials, such as gold, gold plated copper, gold plated nickel, gold-nickel alloy, and other materials. Bracket 1430 may be formed of sheet metal or other material.

In various embodiments of the present invention, different portions of this contact structure and other contact structures may be formed in various ways. For example, cap 1410 and gaskets 1520 may be formed using injection or other molding, printing, or other technique. Contact portions and other conductive portions of contacts 1420 may be machined, stamped, coined, forged, printed, or formed in different ways.

Embodiments of the present invention may provide contact structures that may be located in various types of devices, such as portable computing devices, tablet computers, desktop computers, laptops, all-in-one computers, wearable computing devices, cell phones, smart phones, media phones, storage devices, keyboards, covers, cases, portable media players, navigation systems, monitors, power supplies, adapters, remote control devices, chargers, and other devices. These devices may include contact structures that may provide pathways for signals and power compliant with various standards such as one of the Universal Serial Bus (USB) standards including USB Type-C, HDMI, DVI, Ethernet, DisplayPort, Thunderbolt, Lightning, JTAG, TAP, DART, UARTs, clock signals, power signals, and other types of standard, non-standard, and proprietary interfaces and combinations thereof that have been developed, are being developed, or will be developed in the future. In one example, the contact structures may be used to convey a data signal, a power supply, and ground. In various embodiments of the present invention, the data signal may be unidirectional or bidirectional and the power supply may be unidirectional or bidirectional.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A contact structure comprising:

a housing;

a first contact and a second contact, each comprising:

a flexible lever arm;

a contacting portion attached to a first end of the flexible lever arm, the contacting portion having a wider body portion and a narrowed tail, the narrowed tail located in an opening in the first end of the flexible lever arm; and a barb on a second end of the flexible lever arm, the barb inserted into the housing; and a cover attached to a top of the housing, the cover having a plurality of openings each for a contacting portion of the first and second contacts.

2. The contact structure of claim 1 wherein the contacting portion of each contact is riveted to the first end of the flexible lever arm.

3. The contact structure of claim 1 wherein the cover comprises a raised portion around a plurality of openings.

4. The contact structure of claim 1 wherein the housing comprises a bottom opening to accept an insertion of a central contact and side slots to accept the insertion of the first and second contacts during assembly.

5. The contact structure of claim 1 further comprising a third contact comprising:

a flexible lever arm;

a contacting portion attached to a first end of the flexible lever arm; and a second end of the flexible lever arm, wherein the housing is insert molded around a portion of the third contact.

6. The contact structure of claim 5 further comprising a surface-mount contact portion near the second end of the flexible lever arm of each of the first, second, and third contacts.

7. A contact structure comprising:

a circuit board;

a plurality of spring-biased contacts mounted on a top side of the circuit board;

a cap over the spring-biased contacts and having a plurality of openings, each for a contacting portion of one of the plurality of spring-biased contacts;

a bracket fixed to a bottom side of the circuit board; and a lid over the cap and fixed to bracket, wherein the cap includes a raised portion, the plurality of openings on the raised portion, where the raised portion fits in a first opening in the lid.

8. The contact structure of claim 7 wherein each of the spring-biased contacts comprises:

a housing having a central hole surrounded by a plurality of slots in a top surface;

a spring having a first end in the central hole;

a contacting portion having a back side cavity, a second end of the spring in the back side cavity; and a terminal structure having a number of tabs fit into the plurality of slots in the top surface of the housing and a central passage around the contacting portion.

9. The contact structure of claim 8 wherein the contacting portion includes a first contacting portion tab, the first contacting portion tab under the terminal structure.

10. The contact structure of claim 9 wherein the terminal structure includes two raised portions, wherein the two raised portions fit in the back side cavity of the contacting portion.

11. The contact structure of claim 10 wherein the terminal structure comprises two tabs extending downward that fit in corresponding slots in the housing.

12. The contact structure of claim 7 wherein the circuit board is a flexible circuit board.

13. The contact structure of claim 12 wherein the spring-biased contacts are mounted on the circuit board by inserting terminals of the plurality of spring-biased contacts into openings in the circuit board.

14. The contact structure of claim 12 further comprising a gasket around the raised portion of the cap and between the cap and the lid.

15. The contact structure of claim 14 wherein the lid is fixed to the bracket using threaded inserts that are press-fit into side openings in the bracket and screws that are inserted into side openings in the lid and screwed into the threaded inserts in the bracket.

16. The contact structure of claim 15 wherein the cap is fixed to the circuit board using a first adhesive layer.

17. The contact structure of claim 16 wherein the circuit board is fixed to the bracket using a second adhesive layer.

18. The contact structure of claim 17 wherein the first adhesive layer and the second adhesive layer are heat-activated layers.

* * * * *